US005177890A

United States Patent [19]

Hisatomi et al.

[11] Patent Number: 5,177,890

[45] Date of Patent: Jan. 12, 1993

[54] PANEL FENCE

[75] Inventors: Tetu Hisatomi, Tokyo; Hayasi Takemori, Chiba; Hirosi Omori, Tokyo, all of Japan

[73] Assignees: Iskra Industry Co., Ltd.; Exterior Laboratory Co., Ltd., both of Tokyo, Japan

[21] Appl. No.: 633,486

[22] Filed: Dec. 28, 1990

[30] Foreign Application Priority Data

Feb. 1, 1990 [JP] Japan ..... 2-23389

[51] Int. Cl.[5] ..... G09F 3/06

[52] U.S. Cl. ..... 40/447; 40/618; 40/611; 256/32

[58] Field of Search ..... 40/611, 489, 584, 600, 40/624, 618, 447; 256/24, 32; 24/457, 458, 546, 563, 555, 545, 601.2

[56] References Cited

U.S. PATENT DOCUMENTS

| | | | |
|---|---|---|---|
| 416,826 | 12/1889 | Cooper | 256/32 |
| 793,676 | 7/1905 | Olivera | 40/618 |
| 1,004,810 | 10/1911 | Newell, Jr. | 40/447 |
| 1,481,467 | 1/1924 | Hockin | 40/418 |
| 1,737,549 | 12/1929 | Ballou, Jr. et al. | 24/600.9 |
| 1,740,736 | 12/1929 | Hotchner | 40/618 |
| 2,262,501 | 11/1941 | Johnson | 40/618 |
| 2,636,298 | 4/1953 | MacKlanburg | 40/618 |
| 3,004,145 | 10/1961 | Kroes | 256/13.1 |
| 3,572,640 | 3/1971 | Vecchiarelli | 256/34 |
| 3,774,884 | 11/1973 | Singer | 256/32 |
| 3,964,197 | 6/1976 | Tucker | 40/582 |
| 4,651,975 | 3/1987 | Howell | 256/1 |
| 4,907,783 | 3/1990 | Fisk et al. | 256/32 |
| 5,025,536 | 6/1991 | Vielhauer | 24/563 |

FOREIGN PATENT DOCUMENTS

| | | | |
|---|---|---|---|
| 2626748 | 12/1977 | Fed. Rep. of Germany | 24/573.5 |
| 3431310 | 7/1985 | Fed. Rep. of Germany | 24/601.2 |
| 653257 | 3/1929 | France | 40/618 |
| 1476 | 1/1895 | United Kingdom | 40/618 |
| 1457500 | 12/1976 | United Kingdom | 256/32 |

*Primary Examiner*—Kenneth J. Dorner
*Assistant Examiner*—Cassandra L. Hope
*Attorney, Agent, or Firm*—Frishauf, Holtz, Goodman & Woodward

[57] ABSTRACT

A panel fence is provided with a net having a mesh surface, and meshes are distributed on the whole area of the net surface. These meshes are in the shape of a rectangle and the size is equal. A panel piece is removably and selectively mounted on the mesh and blockades the mesh. The panel pieces mounted on the meshes express pictures, letters or patterns on the net.

17 Claims, 7 Drawing Sheets

PANEL FENCE

BACKGROUND OF THE INVENTION

1. Field of the Invention

The present invention relates to a panel fence which has a decoration effect and can be used as advertising media.

2. Description of the Related Art

Construction sites for buildings and lifelines such as underground water and sewage, gas pipes, electric wires and so on are usually surrounded by fences, and the fences prevent outsiders from trespassing on the sites without a reason.

Fences used at the construction sites are, for example, formed by combining a large number of sheet piles, but a sheet fence formed by these sheet piles has a function of merely surrounding the site and its appearance is not beautiful. Also, net fences are often used for surrounding the construction sites, but these net fences are formed taking into consideration only of its function, which results in poor quality in the beauty.

As sheet fences at the construction sites are usually kept installed for a long time, it is desired to improve the appearance of the sheet fences. Therefore, pictures, letters or patterns are directly drawn on the fences to improve their appearances. On the other hand, for the net fences at the construction sites, pictures, letters and so on are also directly drawn on them, or boards on which pictures and letters are drawn or pieces in the shape of letters are fixed on the net fences to improve their appearances.

However, when the appearances of the sheet fences or net fences are improved in the above manner, it is not easy to change the pictures, letters or patterns on these fences. That is, if pictures, letters or patterns are directly drawn on the fences, other pictures, letters or patterns should be newly drawn on the fences after repainting the fences. Similarly, if boards or pieces are fixed on the fences, new boards or pieces should be fixed on the fences again after preparing those boards or pieces and removing older boards or pieces.

OBJECTS AND SUMMARY OF THE INVENTION

The object of the present invention is to provide a panel fence on which pictures, letters or patterns can be easily produced and changed, which results in effect of use as advertising media as well as improvement in the beauty.

The object mentioned above is achieved by a panel fence of the present invention comprising:

net means having a mesh surface, in which each mesh distributed on the whole area of the mesh surface has the same shape and size and adjoins each other; and a panel piece in the same shape and size as one mesh on the mesh surface, and this panel piece is removably engaged with the mesh and blockades the mesh.

According to the panel fence mentioned above, as one form of use of this panel fence, panel pieces are mounted on all the meshes on the mesh surface and one panel can be formed by these panel pieces. Therefore, if panel pieces painted in various colors are prepared in advance, optional pictures, letters or patterns can be easily produced by properly choosing mounting positions of the panel pieces, that is, the meshes, on which the panel pieces are to be mounted, or colors of the panel pieces. Also, as each of the panel pieces can be removed from the mesh, pictures, letters or patterns on the panel can be easily changed.

As another form of use of the panel fence, pictures, letters or patterns can be produced not only by mounting the panel pieces on all the meshes but also by selectively mounting the panel pieces on the meshes of the mesh surface. In this case, as a part of the mesh surface is exposed to the outside, patterns of the mesh surface itself can be also utilized.

Preferably, the panel piece has a hook portion which can be engaged with a horizontal side of the mesh. With the panel piece having such a hook portion, the panel piece can be easily suspended from the side of the mesh, even if the panel piece is not provided with a separate element able to be engaged with a side of the mesh, and the panel piece can be also easily removed from the mesh. In addition, when the panel piece is in the state of suspension from the side of the mesh through the hook portion, the panel piece is easily swung even by a breeze, and another advantage can be gained that pictures, letters or patterns produced by the panel pieces are changed three-dimensionally.

BRIEF DESCRIPTION OF THE DRAWINGS

The present invention, together with its objects and advantages, will become more fully understood from the detailed description given herein below and the accompanying drawings, which are given by way of illustration only, and thus, are not limitative of the present invention, and wherein.

DETAILED DESCRIPTION OF THE PREFERRED EMBODIMENTS

Figure 1:
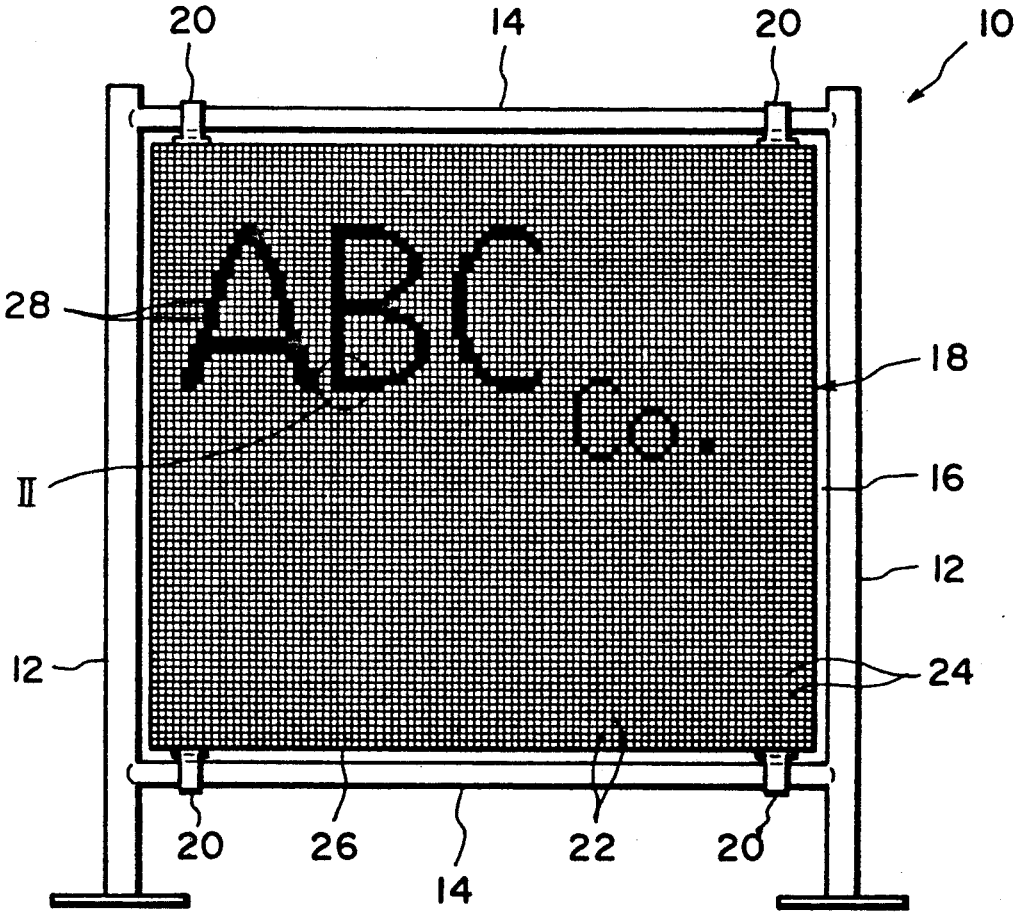
FIG. 1 is a front elevation view illustrating one unit of a panel fence in relation to a first embodiment of the present invention.

Referring to FIG. 1, a part of the panel fence, that is, a fence unit 10 is shown. This unit 10 is provided with a pair of supporting posts 12, and the lower end portions and the upper end portions of these supporting posts are connected by upper and lower cross bars 14 respectively. The supporting posts 12 and the cross bars 14 are made of hollow pipe members.

The supporting posts 12 and the cross bars 14 define a rectangular opening 16 and this opening 16 is covered by a rigid net 18. This net 18 has a flat mesh surface and is mounted to the cross bars 14 by means of upper and lower pairs of net holders 20.

The net 18 is formed by a large number of wires 22 which extend vertically with equal intervals between them in the horizontal direction and a large number of wires 24 which extend horizontally with equal intervals between them in the vertical direction, and the cross-sectional shape of the longitudinal wire 22 and the lateral wire 24 is a circle.

Meshes 26 of the net 18 defined by the vertical wires 22 and the horizontal wires 24 are, as obvious from the above explanation, in the same rectangular shape and the size is also the same.

A large number of panel pieces are mounted on the meshes 26 of the net 18 as shown in FIG. 1, and letters are drawn on the mesh surface of the net 18 by these panel pieces 28.

Figure 2:
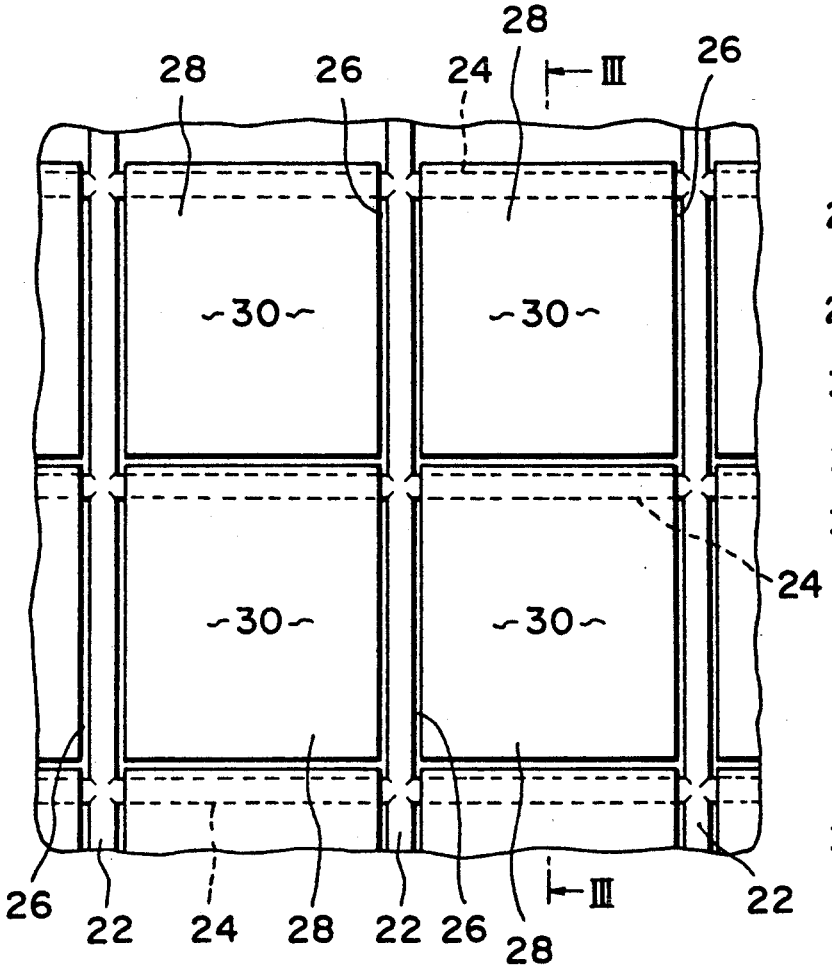
FIG. 2 is an enlarged view of the part II in FIG. 1.
Figure 3:
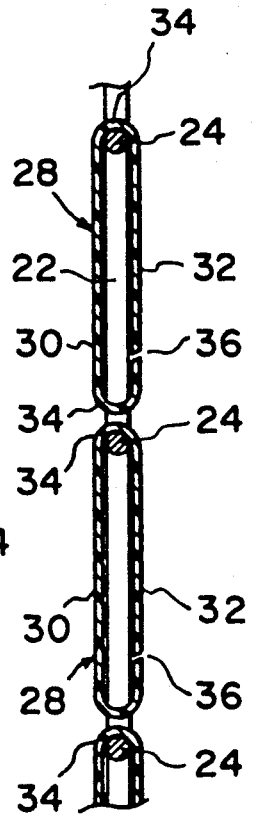
FIG. 3 is a cross-sectional view along the line III—III in FIG. 2.

As shown in detail in FIG. 2 and FIG. 3, the panel piece 28 is a flat loop in shape, and therefore, both the right and left side are opened. That is, the panel piece 28 includes a flat front wall 30 and back wall 32 separated and opposed to each other and curved portions 34 in the shape of an arc which protrude to the outside so that the upper and lower ends of these front wall 30 and the back wall 32 are connected to each other. The front wall 30 and the back wall 32 has a rectangular shape slightly smaller than that of the mesh 26, and the gap between these front wall 30 and the back wall 32 is larger than the diameter of the horizontal wire 24.

Moreover, a slit 36 is formed at the lower portion of the back wall 32. This slit 36 extends from one side of the panel piece 28 from the other side thereof in the width direction of the back wall 32. Thus, a part of the back wall 32 positioned above the slit 36 in view of FIG. 3 can be elastically deformed using the curved portion 34 as a self hinge. In the case of this embodiment, a pair of edge surfaces 38 (FIG. 4) which are opposed to each other in parallel with each other and define the slit 36 are inclined downwardly toward the inside of the panel piece 28 as shown in FIG. 3.

The panel pieces 28 are, for example, made of colored synthetic resin, and thus, the panel pieces 28 can be mass-produced by injection molding.

Figure 4:
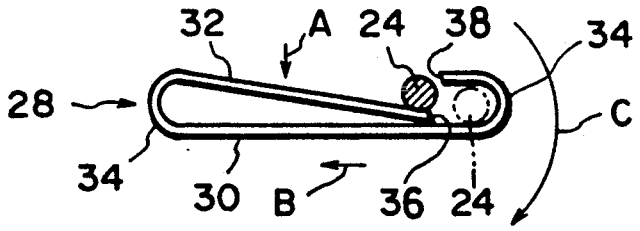
FIG. 4 is an illustration to explain mounting of a panel piece on the mesh surface of the unit.

The panel piece 28 mentioned above can be mounted on one mesh 26 of the net 16 as shown in FIG. 4. That is, first, the back wall 32 of the panel piece 28 is pressed by a hand in the arrow A direction in FIG. 4, by which the opening width of the slit 36 is increased with elastic deformation of the back wall 32. After this, by pulling the panel piece 28 in the arrow B direction in FIG. 4 with contacting the elastically deformed back wall 32 with under side of the portion of the horizontal wire 24 which defines one mesh 26, the portion of the horizontal wire 24 can be positioned in one of the curved parts 34 of the panel piece 28 as shown by the two-dot dashes line in FIG. 4 through the slit 36 whose opening width has been increased. Thereafter the pressure applied to the back wall 32 of the panel piece 28 is released, the back wall 32 returns to the original attitude, and the opening width of the slit 36 also returns to the original size. As a result, the panel piece 28 is mounted on the mesh 26 in the state where it is suspended from the portion of the horizontal wire 24. At this time, if the panel piece 28 is rotated in the arrow C direction in FIG. 4 so that the slit 36 of the panel piece 28 can be positioned on the lower side, the panel piece 28 can be mounted on one mesh 26 as in the same mounting attitude as shown in FIG. 3.

Figure 5:
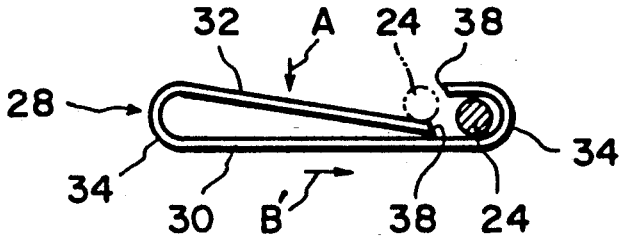
FIG. 5 is an illustration to explain removal of the panel piece from the mesh surface.

On the other hand, when the panel piece 28 is removed from the mesh 26, first, the panel piece 28 is positioned in the attitude shown in FIG. 5. Thereafter, the back wall 32 of the panel piece 28 is pressed in the arrow A direction to be elastically deformed and the panel piece 28 is pushed out in the arrow B' direction which is opposite to the above mentioned arrow B direction. As a result, engagement of the portion of the horizontal wire 24 with the panel piece 28 is released and the panel piece 28 can be removed from the mesh 26.

Moreover, as both the edge surfaces 38 of the back wall 32 are inclined, the horizontal wire 24 of the mesh 26 can easily pass the slit 36 of the panel piece 28 in mounting and removing of the panel piece 28, which further facilitates mounting and removal of the panel piece 28 in relation to the mesh 26.

According to the panel fence of the above mentioned first embodiment, as the panel piece 28 can be mounted each one of the meshes 26 of the net 18, optional letters can be expressed on the net 18 as shown in FIG. 1 using one mounted panel piece 28 as a picture element. Also, as pictures and patterns other than letters can be easily expressed on the net 18 by panel pieces 28, not only that appearance of the panel fence can be improved, but the panel fence can be effectively used as advertising media depending on the expressed information. In expressing pictures, letters or patterns on the net 18 by the panel pieces 28, if the numbers are allocated to each one of the meshes 26 of the net 18, the corresponding relations between the meshes 26 and the panel pieces 28 to be mounted on the meshes become clear, which facilitates production of pictures, letters or patterns on the net 18.

The form of use of the panel fence is not limited to the above mentioned example, but the panel pieces 28 can be mounted on all the meshes 26 of the net 18 to form a panel. When the panel is formed in this manner, pictures, letters or patterns can be expressed on the panel by properly choosing the color of the panel piecec to be mounted.

Moreover, as the panel pieces 28 are removably mounted on the mashes 26, pictures, letters or patterns expressed on the panel can be easily changed.

Still more, as the panel piece 28 mounted on the mesh 26 is in the shape of a loop, the panel piece 28 will not undesirably be disconnected from the mesh 26 and drop. Moreover, as the panel piece 28 is hooked on the portion of the horizontal wire 24 of the mesh 26 through the curved portion 34, the panel piece 28 is easily swung by a wind. Thus, such a swing of the panel pieces 28 three-dimensionally changes pictures, letters or patterns on the net 16 or the panel, which can further improve its advertising effect. Also, as wind can pass each of the panel pieces 28, wind pressure applied to the net 16 or the whole panel fence can be reduced.

In FIG. 1, only one unit 10 which constitutes a part of the panel fence is shown, but it is needless to say that a panel fence in desired length and height can be easily produced by preparing a large number of these units 10 and by connecting these units 10.

The present invention is not limited to the panel fence of the first embodiment but capable of variations, and the variations of the present invention will be explained one by one in the following.

Figure 6:
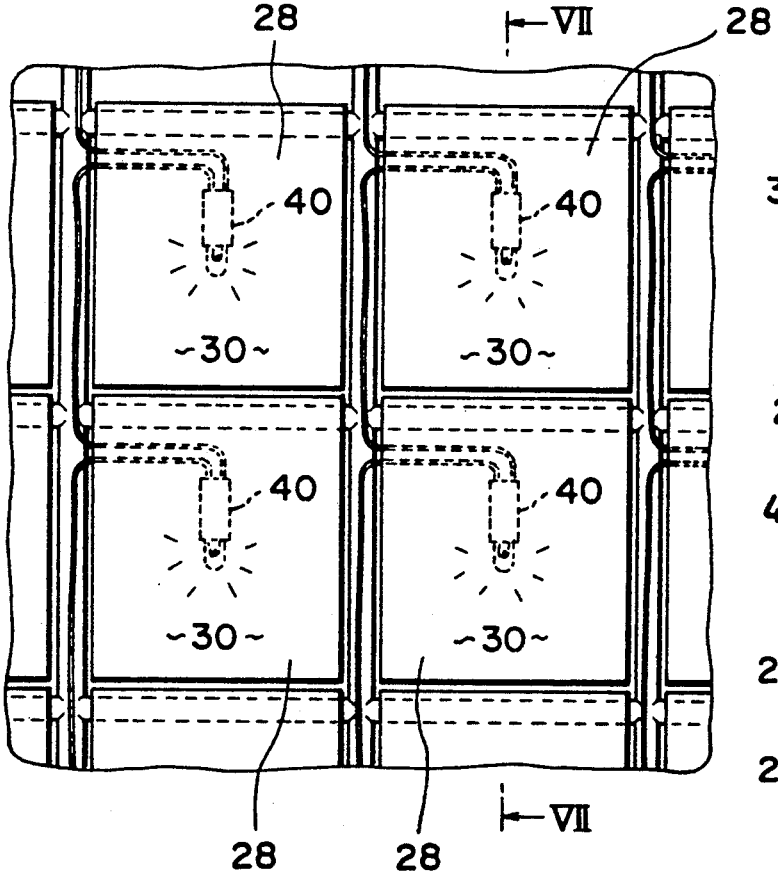
FIG. 6 is a plan view of a part of a panel fence in relation to a second embodiment of the present invention.
Figure 7:
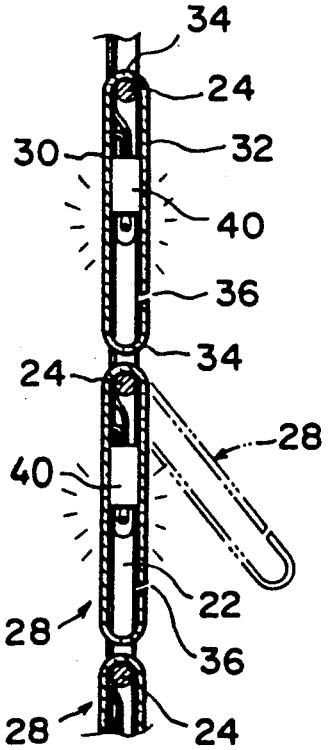
FIG. 7 is a cross-sectional view along the line VII—VII in FIG. 6.

A second embodiment of the present invention is shown in FIG. 6 and FIG. 7. This second embodiment has substantially the same structure as that of the panel fence of the first embodiment, but in the case of the second embodiment, each of the panel pieces 28 is made of synthetic resin having a light penetrability, and light bulbs 40 as a light source are stored in each of the panel pieces 28. These light bulbs 40 are connected to a power circuit, not shown, and this power circuit can switch each of the light bulbs 40 on and off at predetermined time intervals and/or in the predetermined order.

In the case of the second embodiment, not only that pictures, letters or patterns are expressed on the net 18, but visibility of such expressed pictures, letters or patterns can be further improved by turning on or flashing on and off of the light bulbs 40. As a result, not only an effect of the panel fence as advertising media is improved, but the advertising effect can be maintained even at night.

Figure 8:
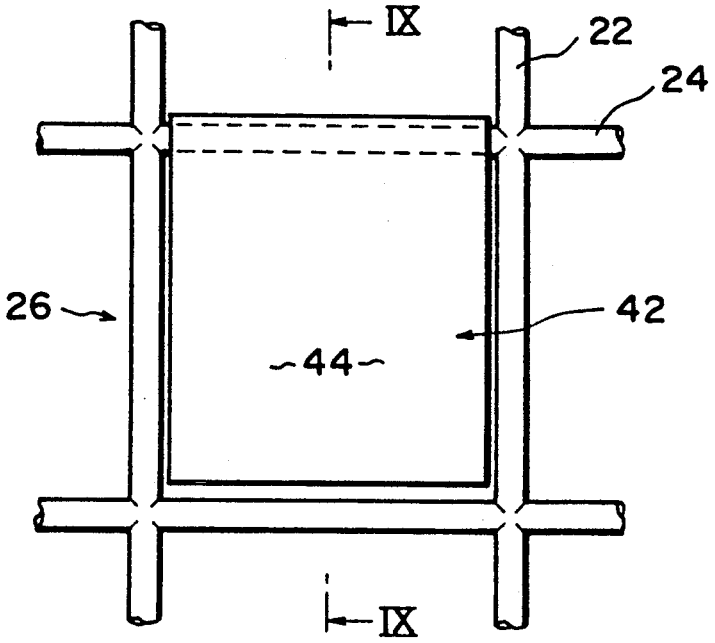
FIG. 8 is a plan view of a part of a panel fence in relation to a third embodiment of the present invention.
Figure 9:
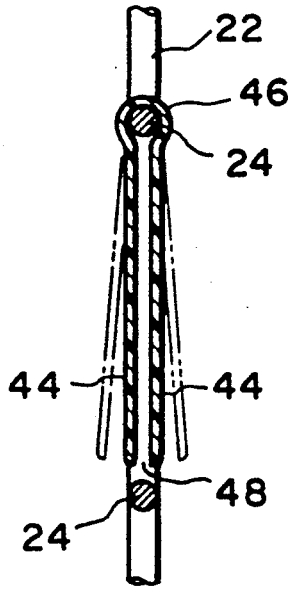
FIG. 9 is a cross-sectional view along the line VIII—VIII in FIG. 8.

Next, a third embodiment of the present invention is shown in FIG. 8 and FIG. 9. A panel piece 42 made of synthetic resin of this third embodiment includes a pair of flat walls 44 separated and opposed to each other and a curved portion 46 in the shape of a semi circle which protrudes to the outside so that the upper ends of these flat walls 44 are connected to each other. The inner diameter of this curved portion 46 is slightly larger than the diameter of the horizontal wire 24 of the mesh 26, while the gap between the pair of flat walls 44 is smaller than the inner diameter of the curved portion 46. Thus, the panel piece 42 of the third embodiment has an opening 48 at the lower end thereof.

In the above mentioned panel piece 42, the pair of flat walls 44 can be also elastically deformed as shown by the two-dot dashes line in FIG. 9, and thus, the panel piece 42 can be mounted on the mesh 26 by inserting the portion of the horizontal wire 24 of the mesh 26 into the curved portion 46 through the opening 48 of the panel piece 42. When the panel piece 42 is pulled out to above the mesh 26 after this, the panel piece 42 can be removed from the mesh 26. As a result, not only that the panel piece 42 of the third embodiment can be swingably mounted on the mesh 26 as the above mentioned panel piece 28, but its mounting and removal are easier than that of the panel piece 28.

It is obvious that even though the panel piece 42 has the opening 48 at its lower end, it will not easily disconnected from the mesh 26 and drop.

Moreover, as the panel piece 28 is provided with the slit 36, the wall with the slit 36 inevitably becomes the back wall 32, and the other wall without the slit 36 becomes the front wall 30. However the panel piece 42 of the third embodiment does not have a relation of front and back between the pair of flat walls 44. Thus, in the case of the panel piece 42, different colors can be put on the outer surfaces of the pair of flat walls 44, by which one panel piece 42 can be used in two ways.

Figure 10:
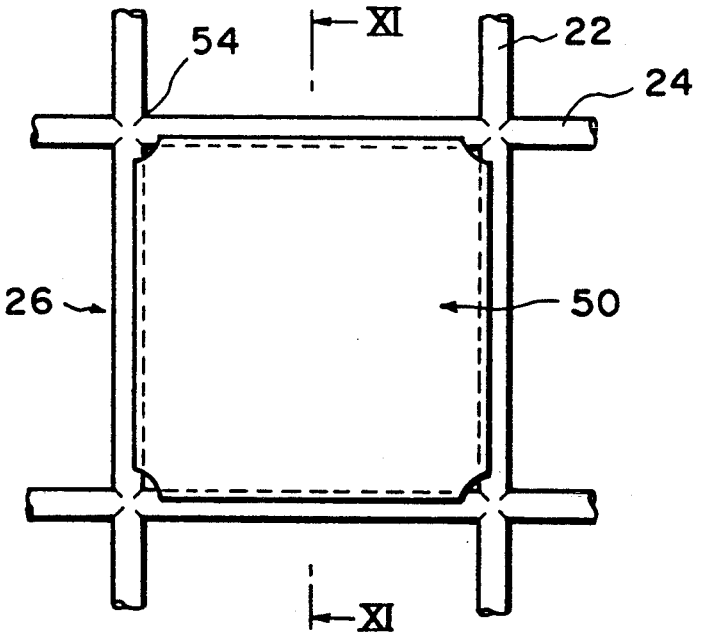
FIG. 10 is a plan view of a part of a panel fence in relation to a fourth embodiment of the present invention.
Figure 11:
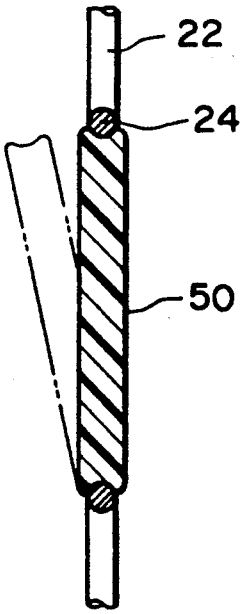
FIG. 11 is a cross-sectional view along the line XI—XI in FIG. 10.
Figure 12:
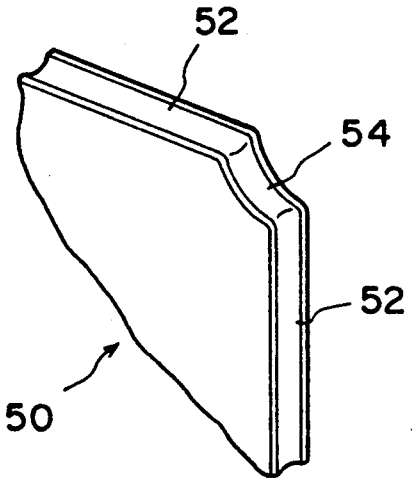
FIG. 12 is a perspective view of the part of a panel fence of FIG. 10.

A fourth embodiment of the present invention is shown in FIG. 10 through FIG. 12. A panel piece 50 of this fourth embodiment is not to be suspended from the portion of the horizontal wire 24 which defines the mesh 26 as the above mentioned panel pieces 28 and 42, but it can be mounted on this mesh 26 by fitting it into the mesh 26. That is, the panel piece 50 is made of a synthetic resin plate material in the same rectangular shape as the mesh 26, and this plate material is made flexible to a certain degree. A groove 52 is formed on the peripheral edge of the panel piece 50 or each side thereof. The portion of the vertical wire 22 and the horizontal wire 24 are able to fit into the groove 52, respectively. Moreover, notches 54 in the shape of an arc are formed at each corner of the panel piece 50 so as to avoid crossing points of the vertical wires 22 and the horizontal wires 24.

The panel piece 50 of the fourth embodiment can be mounted to the mesh 26 by fitting the panel piece 50 into the mesh 26 while the panel piece 50 is elastically deformed. On the other hand, when the panel piece 50 is pressed by a finger and so on to be elastically deformed after this, the panel piece 50 can be easily removed from the mesh 26.

Figure 13:
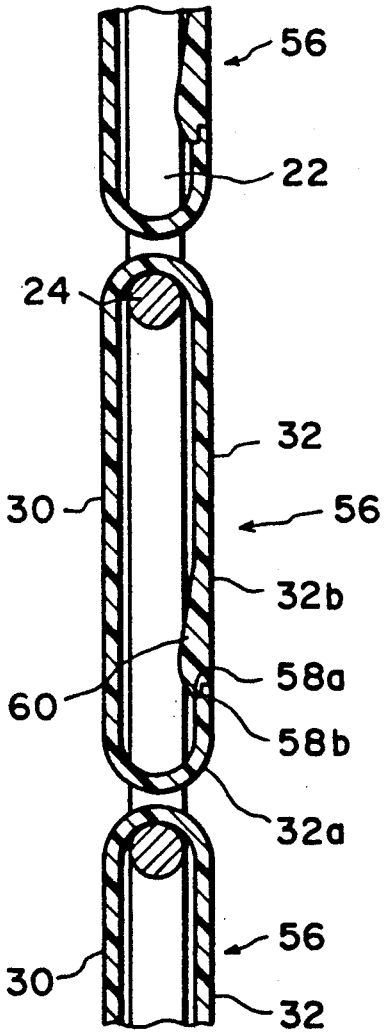
FIG. 13 is a cross-sectional view of a part of a panel fence in relation to a fifth embodiment of the present invention.
Figure 16:
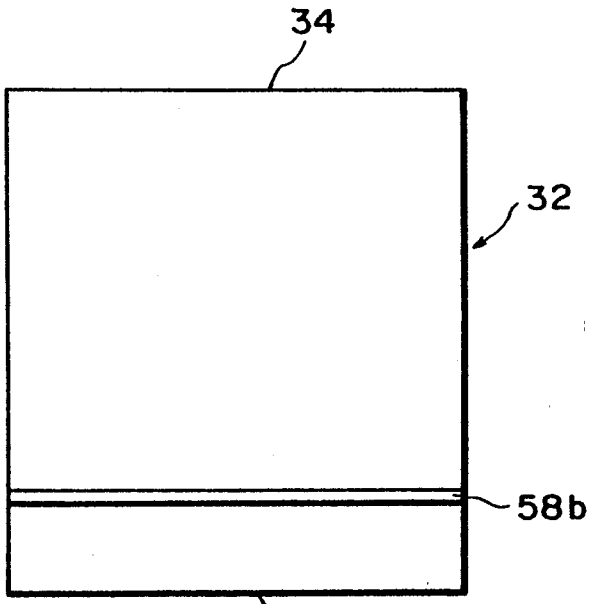
FIG. 16 is a back view of the panel piece of FIG. 13.

A fifth embodiment of the present invention is shown in FIG. 13 through FIG. 18. A panel piece 56 made of synthetic resin of this fifth embodiment is in the same shape as the panel piece 28 of the first embodiment, but the panel piece 56 does not have the part corresponding to the slit 36 of the panel piece 28 as shown in FIG. 13. That is, the edge surfaces of the panel piece 56 corresponding to the end edge surfaces 38 of the panel piece 28 is formed as stepped surfaces **58*a* and 58*b* which are engaged with each other from the inside of the panel piece 56. Moreover, on the back wall 32 of the panel piece 56, the inner surface of the part leading to the stepped surface 58*b* is formed as a bulge part 60 which protrudes to the inside of the panel piece 56**.

Figure 14:
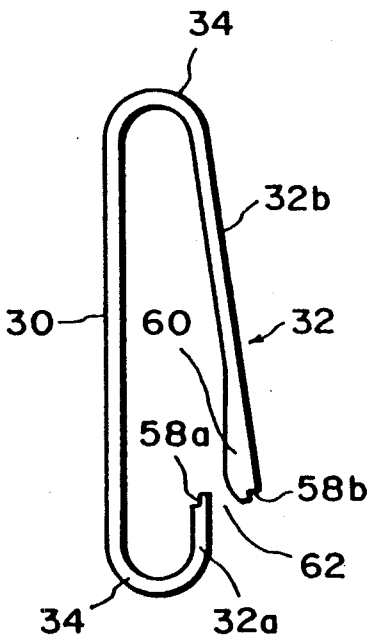
FIG. 14 is a side view of the panel piece of FIG. 13.
Figure 15:
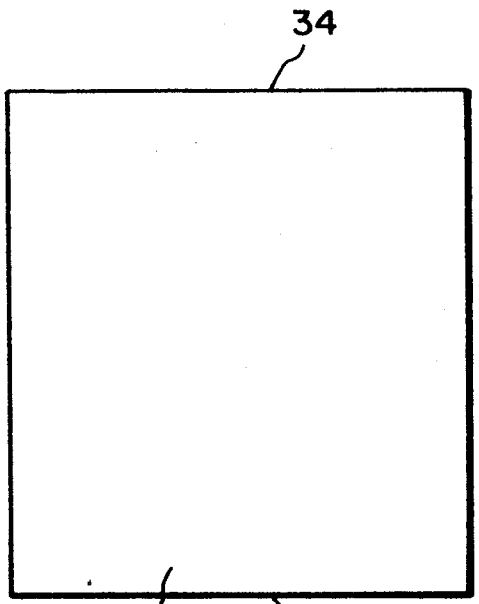
FIG. 15 is a front elevation view of the panel piece of FIG. 13.

The above mentioned panel piece 56 is in the shape shown in FIG. 14 in the natural state. As is obvious from FIG. 14, in the back wall 32 of the panel piece 56, the stepped surface **58*b* on the upper part 32*b* is separated to the outside from the stepped surface 58*a* of the lower part 32*a*. Thus, in the state in FIG. 14, a predetermined gap 62 is defined between the stepped surfaces 58*a* and 58*b***.

Figure 18:
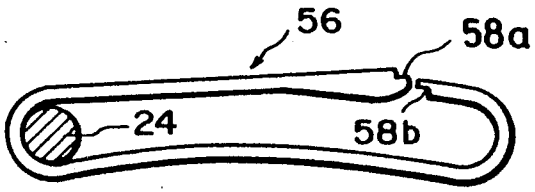
FIG. 18 is an illustration to explain removal of the panel piece of FIG. 13.
Figure 17:
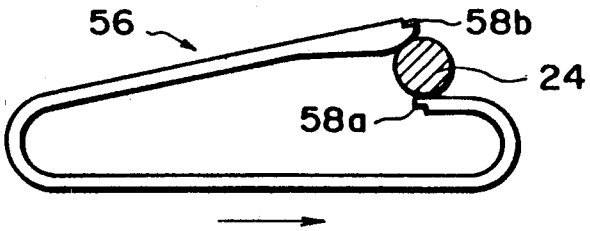
FIG. 17 is an illustration to explain mounting of the panel piece of FIG. 13 on the mesh surface.

The panel piece 56 can be mounted on the mesh 26, as shown in FIG. 17, by passing the horizontal wire 24 of the mesh 26 through the gap 62. When, after this, the upper part **32*b* on the back wall 32 is pressed to be elastically deformed and the pressing force is released after the upper part 32*b* is positioned to the inside of the panel piece 56. As a result, the stepped surface 58*b* on the upper part 32*b* and the stepped surface 58*a* on the lower part 32*a* of the back wall 32 can be fit into each other as shown in FIG. 13 by restoring force of the upper part 32*b*. On the other hand, when the center portion of the front wall 30 of the panel piece 56 is pressed by a finger and so on to elastically deform the whole panel piece 56 as shown in FIG. 18, engagement between the stepped surfaces 58*a* and 58*b* is released and at the same time, the gap 62 is defined between these stepped surfaces 58*a* and 58*b* by restoring force of the upper part 32***b* of the back wall 32. Thus, the panel piece 56 can be removed from the mesh 26 by taking out the portion of the lateral wire 24 of the mesh 26 through this gap 62 after this.

According to the above mentioned panel piece 56, as the bulge portion 60 is formed on the upper part 32*b* of the back wall 32, the horizontal wire 24 of the mesh 26 can pass the gap 62 between the stepped surfaces 58*a* and 58*b* guided by this bulge portion 60, which further facilitates mounting and removal of the panel piece 56 in relation to the mesh 26.

Moreover, in the mounting state of the panel piece 56, the lower part 32*a* and the upper part 32*b* of the back wall 32 are connected to each other in the state where the stepped surfaces 58*a* and 58*b* are pressed by each other by elasticity of the upper part 32*b* of the back wall 32. Thus, the connection part of the lower part 32*a* and upper part 32*b* will not easily be disconnected. Also, as the wall thickness in the vicinity of this connection part is increased by existence of the bulge part 60, strength of the connection part is increased and durability of this connection part can be improved.

Figure 19:
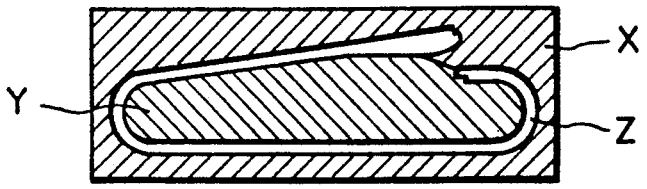
FIG. 19 is a perspective view illustrating a part of the panel piece of the FIG. 13 in an enlarged manner.

Any of the above panel pieces 28, 42 or 56 can be produced by injection molding, and a male and a female molds are used for this injection molding. That is, explaining injection molding in brief, first, a male and a female molds Y and X are assembled as shown in FIG. 19, a cavity Z to form a panel piece defined prescribed between these molds X and Y, and molten synthetic resin is injected in this cavity Z to form a panel piece. Thereafter, the formed panel piece is removed from the molds X and Y. FIG. 19 shows the molds X and Y for the panel piece 56.

Specially, it is necessary to first pull out the male mold Y from the panel piece to remove the formed panel piece from the male and female molds Y and X, and for that purpose, for example, the male mold Y is in such a shape that the cross section is increased in its pulling out direction. That is, the peripheral surface of the male mold Y is tapered by a predetermined angle. When the shape of the panel piece is considered here, the pulling out direction of the male mold Y coincides with the width direction of the panel piece. Therefore, the tapered peripheral surface of the male mold Y makes the wall thickness of the curved portion 34 and 46 of the formed panel piece to increase or decrease in the width direction of the panel. Thus, if such a panel piece is mounted on the portion of the horizontal wire 24 of the mesh 26, this panel piece is inclined to the width direction, which worsens its mounting attitude.

Figure 20:
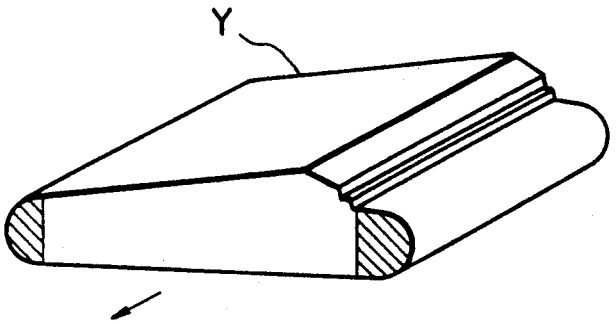
FIG. 20 is a cross-sectional view of a male and a female molds for injection molding the panel piece of FIG. 13.
Figure 21:
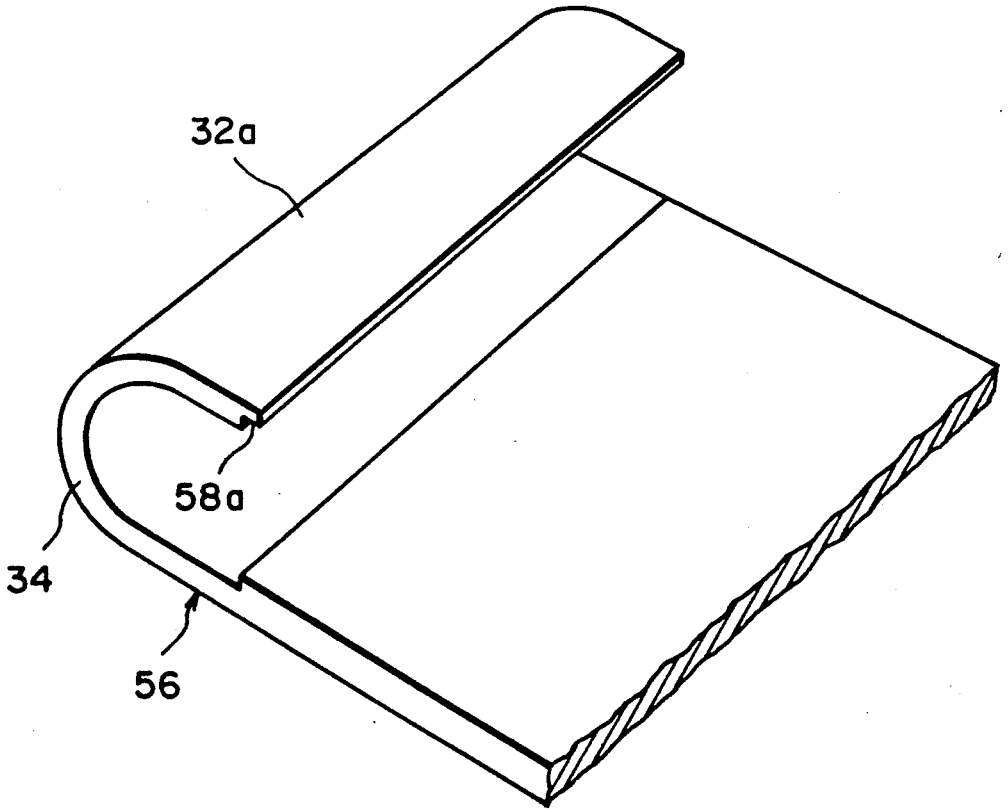
FIG. 21 is a perspective view illustrating a part of the male mold of FIG. 20.

Therefore, in producing the panel piece of the present invention by injection molding, only the cross section of the part of the male mold Y to be used for forming of the curved portion of the panel piece, that is, the cross section of the part shown by the shaded portion in FIG. 20 is made uniform in the pulling out direction of the mold Y, and only the peripheral surface of the other part of the mold Y is tapered. Thus, when a panel piece is injection molded using such a mold Y and X, as the wall thickness of the curved portion 34 of the panel piece is made uniform in the width direction of the panel piece as shown in FIG. 21. Therefore, this panel piece is not inclined and the mounting attitude of the panel piece can be kept good, when the panel piece is mounted on the mesh 26. FIG. 21 shows a part of the front wall of the panel piece. As obvious from FIG. 21, the inner flat surface of the front wall is inclined in the pulling out direction of the mold Y.

Any of the above mentioned panel pieces is made of synthetic resin, which includes polyolefin, polystyrene, polyvinyl chloride, ABS resin, polymethyl methacrylate, polyacrylate, polyvinyl acetate, polyacrylonitrile, thermoplastic polyester, polyamide, polybutadiene, polycarbonete, phenolic plastic, urea resin, melamine resin, unsaturated polyester, polyolefin coupled with a metal ion, straight polymer of thermoplastic rubber, etc. Other than the above synthetic resins, the panel piece can be also made of copolymerization resins from more than two kinds of the above synthetic resins or polymer alloys from more than two kinds of the above synthetic resins, or moreover of homogeneous mixtures of more than two kinds of straight polymers, copolymerization resins and polymer alloys.

Still more, if the panel piece is made of the above synthetic resins to which rubber such as styrene-butadiene rubber, ethylene-propylene rubber, nitril rubber, natural rubber, etc. is added, impact resistance of this panel piece can be further improved.

A material for the panel piece, other than synthetic resin, can be, for example, iron, aluminum, copper and other metals or alloys, or these metal materials to which plating is given.

If the panel piece is made of synthetic resin, the synthetic resin can be colored in advance before forming, or coloring paints such as organic pigments, inorganic pigments, dyes, fluorescent paints can be applied on the panel piece after forming.

Red, orange, pink, brown, flesh color, yellow, green, blue, light blue, black, white, gray, purple and so on can be considered for the color of the panel piece, but intermediate colors of them and any color can be also considered.

In the preferred embodiments mentioned above, the net 16 may be formed by weaving the vertical wires 22 and the horizontal wires 24. Also, the shape of the mesh 26 of the net 18 and the panel piece 26 to be mounted on this mesh is not necessarily limited to a rectangle, but the mesh and the panel piece can be, for example, in the shape of a hexagon.

Use of the panel fence of the present invention is various and it can be used, for example, not only for an outer fence of park, a hand rail for a bridge and a pedestrian overpass or a protection net at a construction site, but also for a billboard installed along a railway or a road, and further for an indoor interior panel.

What is claimed is:

1. A panel fence comprising:

net means having a vertical mesh surface, the mesh surface being formed by a plurality of intersecting wire-like portions defining open spaces therebetween, each open space having substantially an identical shape and size and having at least one horizontally extending wire-like portion; and a plurality of panel pieces, each panel piece having an elastically deformable portion so as to be removably attached to one of said at least one horizontally extending wire-like portion and each panel piece having a corresponding peripheral shape and peripheral size so as to substantially cover said open space, each of the panel pieces being an integral molded piece of synthetic resin and having a hook portion associated with said elastically deformable portion for swingably and removably engaging said horizontally extending wire-like portion, the panel pieces being swingably hung from said horizontally extending wire-like portion by means of their respective elastically deformable portions and hook portions;

each of the panel pieces including a pair of parallel walls, each of said parallel walls having said corresponding shape and size and facing each other at a predetermined distance for defining a space therebetween, each of said parallel walls having horizontally extending first and second opposed edges which are integrally joined, first edge of one wall to the first edge of the other wall and second edge of one wall to the second edge of the other wall, by a pair of elastically resilient curved portions, each of the curved portions having an inner diameter large enough to receive the horizontal wire-like portion, one of the curved portions serving as said hook portion; and separating means forming an opening in one of the parallel walls and thereby separting same such that the horizontal wire-like portion is passable through said opening when said one of the parallel walls is open.

2. A panel fence according to claim 1, wherein the pair of parallel walls is slightly smaller than said open space, and the curved portion has an inner diameter which enables encirclement of a substantial portion of the periphery of the horizontal wire-like portion and functions as a self hinge against the pair of parallel walls.

3. A panel fence according to claim 1, wherein said pair of curved portions extend from one side edge to another side edge.

4. A panel fence according to claim 4, wherein said pair of curved portions each have a substantially uniform thickness.

5. A panel fence according to claim 1, wherein said separating means includes a slit in said one of the parallel walls and extending from one side edge to another side edge of said one parallel wall, the slit being located in the vicinity of one of the curved portions to thereby divide said one parallel wall into a large, first portion close to the other of the curved portions and a small, second portion close to said one of the curved portions, the first portion being elastically deformable and the other of the curved portions serving as a self-hinge, whereby, when the first portion is elastically deformed toward the space between the parallel walls of the panel piece, said opening is defined between the first and second portions for permitting the horizontal wire-like portion to be passed therethrough, and when the first portion is released from an elastically deformed position, the opening is substantially closed by resilient movement of the first portion from the deformed position to an initial undeformed position thereof.

6. A panel fence according to claim 5, wherein said first and second portions have end faces defining the slit, the end faces being substantially parallel to each other and inclined downward toward the space when the panel piece is hung from the horizontal wire-like portion with the other of the curved portions serving as the hook portion.

7. A panel fence according to claim 1, wherein said separating means includes a gap in one of the parallel walls in the vicinity of one of the curved portions and extending from one side edge to another side edge of said one parallel wall, the gap permits the horizontal wire-like portion to be passed therethrough and dividing said one parallel wall into a large, first portion close to the other of the curved portions and a small, second portion close to said one of the curved portions, the gap being defined between ends of the first and second portions close to each other when the first portion of one of said first parallel walls is inclined with respect to the other of the walls in its free state so that a distance between the first portion and the other of the walls increases toward the second portion; and engaging means for closing the gap such that, after the first portion and the other of the walls are deformed toward each other, with the other of the curved portions serving as self-hinges, to bring the end of the first portion into the space, the engaging means causes the end of the first portion to engage with the end of the second portion when the first portion and the other of the walls are released from the elastic deformation, to thereby close the gap.

8. A panel fence according to claim 7, wherein said engaging means includes a stepped portion formed at an end portion of the first portion and facing outward, and a stepped portion formed at an end portion of the second portion and facing inward for engagement with the stepped portion of the first portion.

9. A panel fence according to claim 8, wherein said engaging means further includes a bulge formed on an inner surface of the first portion facing the space and which extends to the end of the first portion.

10. A panel fence according to claim 1, wherein the panel pieces are made of synthetic resin having light penetrability, and the panel pieces further include a light source arranged in said space defined between the parallel walls.

11. A panel fence according to claim 10, wherein said light source comprises a light bulb.

12. A panel fence according to claim 1, wherein said wire-like portions of said net means comprises a plurality of horizontal wire portions spaced from each other and a plurality of spaced apart vertical wire portions which intersect said horizontal wire portions.

13. A panel fence according to claim 1, wherein each of said horizontal wire portions has a substantially circular cross-section.

14. A panel fence according to claim 1, wherein each of said horizontal wire-like portions has a substantially circular cross-section.

15. A panel fence according to claim 1, wherein each panel piece has a peripheral shape and size slightly less than the peripheral shape and size of the open space which it substantially covers.

16. A panel fence comprising:

net means having a mesh surface, in which a plurality of meshes are distributed on the whole area of the mesh surface, each mesh having substantially the same shape and size and adjoining each other; and a panel piece having substantially the same shape and size as one mesh on the mesh surface, and the panel piece being removably engaged with one mesh substantially covers the mesh;

a mesh adjoining the other in a vertical direction being divided by a pair of horizontal wire portions of the same length which extend horizontally and are separated in the vertical direction;

the panel piece having a hook portion removably engaged with one of the horizontal wire portions of the mesh;

the hook portion having a substantially uniform thickness along the horizontal wire portion when engaged with the horizontal wire portion;

the panel piece being made of an integral molding of synthetic resin, and the panel piece including a pair of parallel walls, having an area slightly smaller than the corresponding area of the mesh, each of said parallel walls having first and second horizontal side edges which correspond to both the horizontal wire portions of a mesh, respectively, a pair of curved portions connected between the first side edges and between the second side edges of the pair of parallel walls, respectively, said pair of curved portions spacing said parallel walls from each other to provide a space therebetween, and separating means in one of the parallel walls for separating said one of the parallel walls into two wall parts, and the curved parts having an inner diameter which enables engagement with a horizontal wire portion, and the separating means allowing the separated one of the parallel walls to elastically deform from the corresponding curved portion as a self hinge;

said synthetic resin having light penetrability; and a light source arranged in said spaces defined between the parallel walls of the panel piece.

17. A panel fence according to claim 16, wherein said light source comprises a light bulb.

* * * * *